US009149122B1

(12) United States Patent
Jannetides et al.

(10) Patent No.: US 9,149,122 B1
(45) Date of Patent: Oct. 6, 2015

(54) CHAIR PALLETIZING METHOD

(75) Inventors: James J. Jannetides, Fishers, IN (US); Adam Anderson, Indianapolis, IN (US); Justin Davis, Noblesville, IN (US)

(73) Assignee: J Squared, Inc., Greenfield, IN (US)

( * ) Notice: Subject to any disclaimer, the term of this patent is extended or adjusted under 35 U.S.C. 154(b) by 791 days.

(21) Appl. No.: 13/289,851

(22) Filed: Nov. 4, 2011

Related U.S. Application Data

(60) Provisional application No. 61/410,137, filed on Nov. 4, 2010.

(51) Int. Cl.
*A47C 3/04* (2006.01)
*B65D 19/44* (2006.01)

(52) U.S. Cl.
CPC .. *A47C 3/04* (2013.01); *B65D 19/44* (2013.01)

(58) Field of Classification Search
CPC ..... A47C 3/04; B65D 19/00; B65D 19/44
USPC ..... 297/239; 211/194; 53/447, 399, 441
See application file for complete search history.

(56) References Cited

U.S. PATENT DOCUMENTS 3,338,591 A * 8/1967 Rowland ..... 280/79.11
4,290,645 A 9/1981 Glickman et al.
4,366,980 A * 1/1983 Rowland ..... 297/239
4,456,296 A * 6/1984 Rowland ..... 297/239
4,522,444 A 6/1985 Pollock
4,548,441 A 10/1985 Ogg
4,850,647 A 7/1989 Engel
4,977,836 A 12/1990 Bond
5,050,933 A 9/1991 Tornero et al.
5,064,247 A 11/1991 Clark et al.
5,078,185 A 1/1992 Angarola
5,123,702 A 6/1992 Caruso
5,174,548 A 12/1992 Mueller
5,282,669 A 2/1994 Barile
5,524,963 A 6/1996 Barile
5,678,389 A 10/1997 Henry
5,685,234 A 11/1997 Grigsby et al.
5,762,396 A 6/1998 Barile
5,813,722 A 9/1998 Smith
5,967,605 A 10/1999 Stanfield
D423,807 S 5/2000 Bartlmae
6,059,514 A 5/2000 Sanchez
6,109,857 A 8/2000 Trygg
D433,836 S 11/2000 Barile
(Continued)

FOREIGN PATENT DOCUMENTS

CA 2068120 A * 11/1992
EP 524868 A1 * 1/1993

*Primary Examiner* — Andrew M Tecco
(74) *Attorney, Agent, or Firm* — William F. Bahret

(57) ABSTRACT

A system and method of stacking chairs which includes arranging stackable chairs in multiple substacks separately coupled together, and mounting one substack on another with a forklift using auxiliary lift means removably provided on each substack to be lifted. According to another aspect of the invention, a method is provided for palletizing stackable chairs of the type having frames configured such that, when stacked, each stacked chair is offset toward the front of the chair on which it is stacked, the method comprising providing a pallet having an upper surface defining a generally horizontal plane and having a riser on the upper surface proximate the perimeter thereof, and creating a stack of the chairs on the pallet with the front legs of the bottom chair on the riser.

10 Claims, 10 Drawing Sheets

(56) References Cited

U.S. PATENT DOCUMENTS

| | | | |
|---|---|---|---|
| 6,293,398 | B1 | 9/2001 | Grigsby |
| 6,298,636 | B1 | 10/2001 | Lachenmeier et al. |
| 6,450,575 | B1 | 9/2002 | Liu |
| 6,905,021 | B2 | 6/2005 | Polumbaum et al. |
| 6,915,622 | B2 | 7/2005 | Spatafora |
| 6,938,557 | B1 | 9/2005 | Grigsby |
| 7,032,747 | B2 | 4/2006 | Boche et al. |
| 7,152,738 | B2 | 12/2006 | Pigott et al. |
| 7,360,784 | B2 | 4/2008 | Stewart et al. |
| 7,401,854 | B2 | 7/2008 | Adams |
| 7,503,571 | B2 | 3/2009 | Cromie |
| 7,552,968 | B2 | 6/2009 | Smith et al. |
| D603,179 | S | 11/2009 | Kubryk |
| 8,029,059 | B2 | 10/2011 | Smith et al. |

* cited by examiner

CHAIR PALLETIZING METHOD

CROSS-REFERENCE TO RELATED APPLICATION

This application claims the benefit of Provisional Patent Application No. 61/410,137, filed Nov. 4, 2010, which application is hereby incorporated by reference along with all references cited therein.

BACKGROUND OF THE INVENTION

This invention relates to stacking chairs on a pallet and to a method to facilitate loading and unloading of chairs on a pallet for transportation or storage. Full stacks of chairs can reach heights of 96" or more and, at such heights, are difficult to unload by hand. Also, as shown in FIG. 1A, a conventional stack of chairs can develop a steadily increasing forward lean or offset with each successive chair, which contributes to instability as well as a larger footprint.

SUMMARY OF THE INVENTION

The present invention provides a novel system and method of stacking chairs.

One aspect of the invention is an assembly of stackable chairs arranged to facilitate handling. The assembly comprises a stack of chairs including first and second substacks separately coupled together, the first substack mounted on the second substack, and auxiliary lift means removably provided on the first substack for separately lifting it with a forklift.

According to another aspect of the invention, a method is provided for stacking chairs on a pallet so as to facilitate loading and unloading of the chairs on the pallet for transportation and/or storage. The method comprises providing a lower group of stackable chairs on the pallet, the lower group including first and second stacks of chairs facing toward or away from each other, and mounting an upper group of stackable chairs on the pallet, the upper group including third and fourth stacks of chairs separately coupled together such that each stack can be lifted as a unit, the third and fourth stacks being mounted on the pallet simultaneously.

According to another aspect of the invention, a method is provided for palletizing stackable chairs of the type having frames configured such that, when stacked, each stacked chair is offset toward the front of the chair on which it is stacked, the method comprising providing a pallet having an upper surface defining a generally horizontal plane and having a riser means on the upper surface proximate the perimeter thereof, and creating a stack of the chairs on the pallet with the front legs of the bottom chair on the riser means.

The objects and advantages of the present invention will be more apparent upon reading the following detailed description in conjunction with the accompanying drawings.

DESCRIPTION OF PREFERRED EMBODIMENTS

Figure 1A:
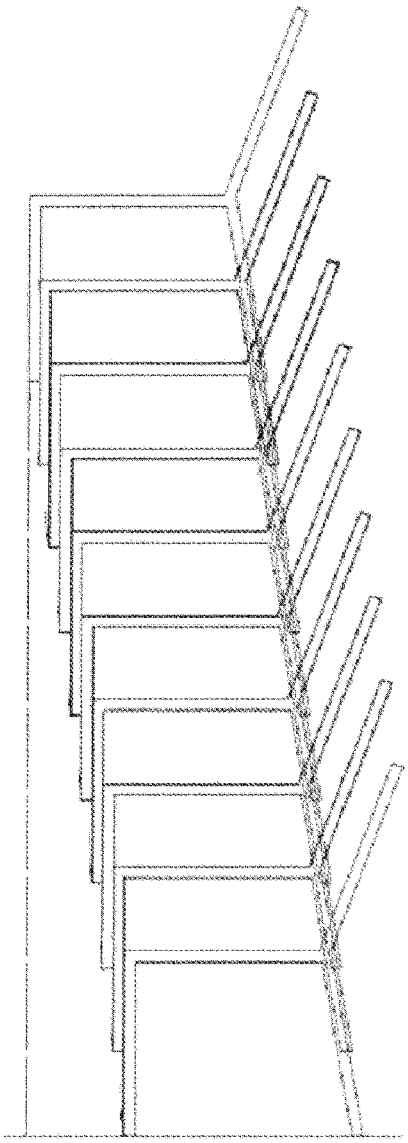
Fig. 1A Prior Art
FIG. 1A illustrates a conventional stack of chairs exhibiting a forward lean or offset.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Figure 1B:
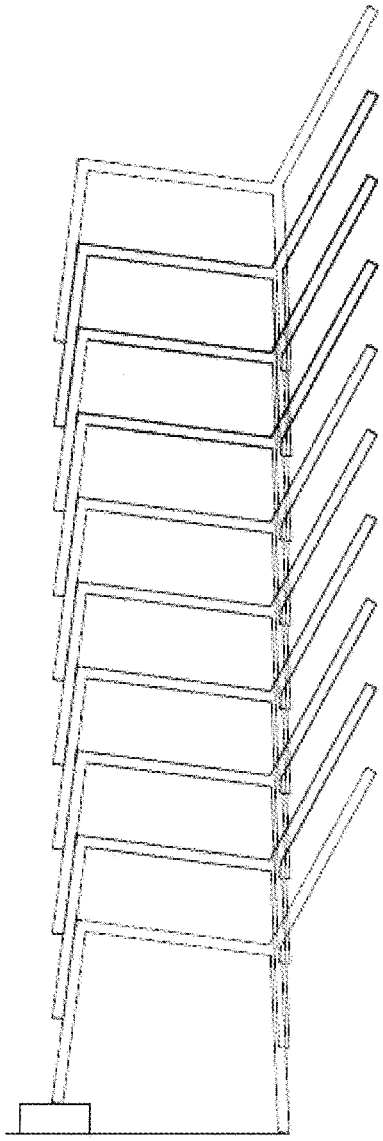
FIG. 1B illustrates one embodiment of a set of chairs stacked in accordance with the present invention.

FIG. 1A illustrates, as noted above, a conventional stack of chairs in which the stack develops a steadily increasing forward lean or offset with each successive chair, which contributes to instability as well as a larger footprint. FIG. 1B illustrates one embodiment of a set of chairs stacked in accordance with the present invention. In the illustrated embodiment, the front legs of the bottom chair are on a riser block which enables the height of the stack to be increased with each successive chair without producing a horizontal offset of the upper chairs relative to the bottom chair.

Figure 2:
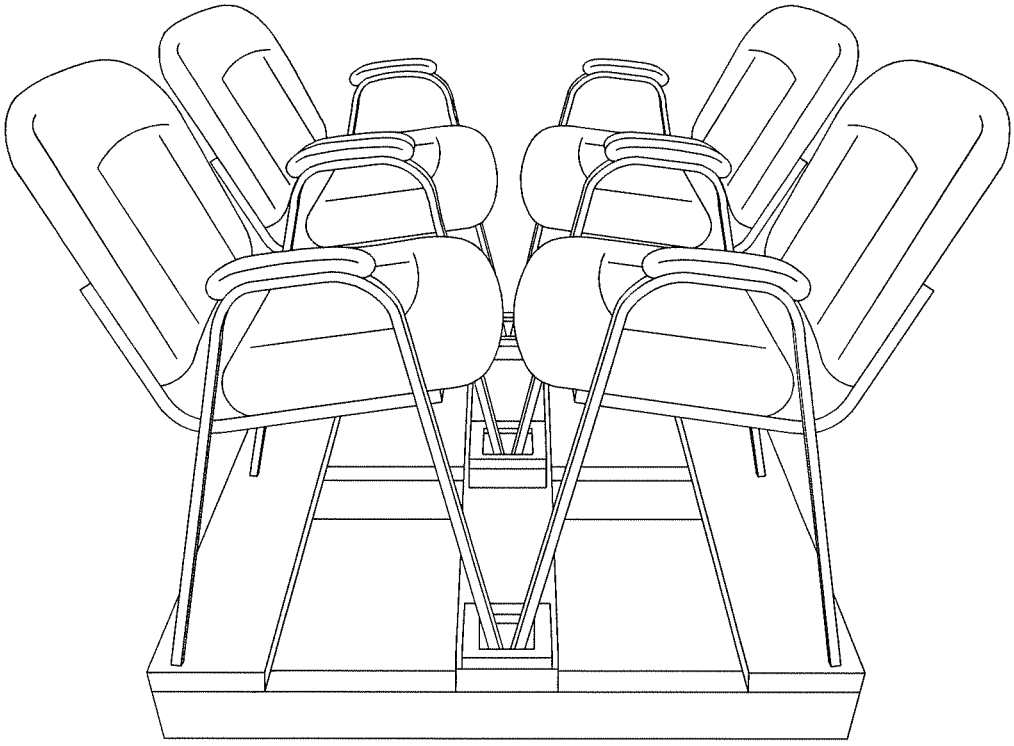
FIG. 2 shows an example arrangement of four chairs on a pallet with riser blocks to elevate the front legs of the chairs.
Figure 3:
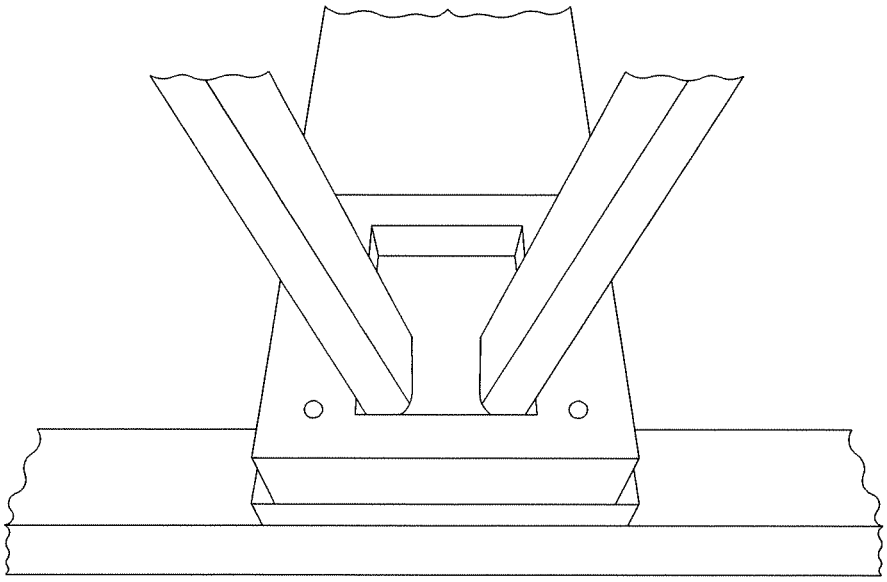
FIG. 3 shows a riser block in more detail.

FIG. 2 shows an example arrangement of four chairs on a pallet with riser blocks to elevate the front legs of the chairs. The top of each riser block may include a recessed area, as shown in FIG. 2 and in more detail in FIG. 3, to guide a chair into position during placement on the pallet and then to horizontally constrain the chair leg on the riser block. The present invention is applicable to chairs with arms as in FIG. 2 as well as to chairs without arms as shown in the subsequent drawings.

According to the present invention, a stack of chairs can be divided into two or more distinct vertically aligned stacks for easier handling. Similarly, a group of stacks can be divided into distinct lower and upper groups such as those shown in FIGS. 4 and 5, respectively.

Figure 4:
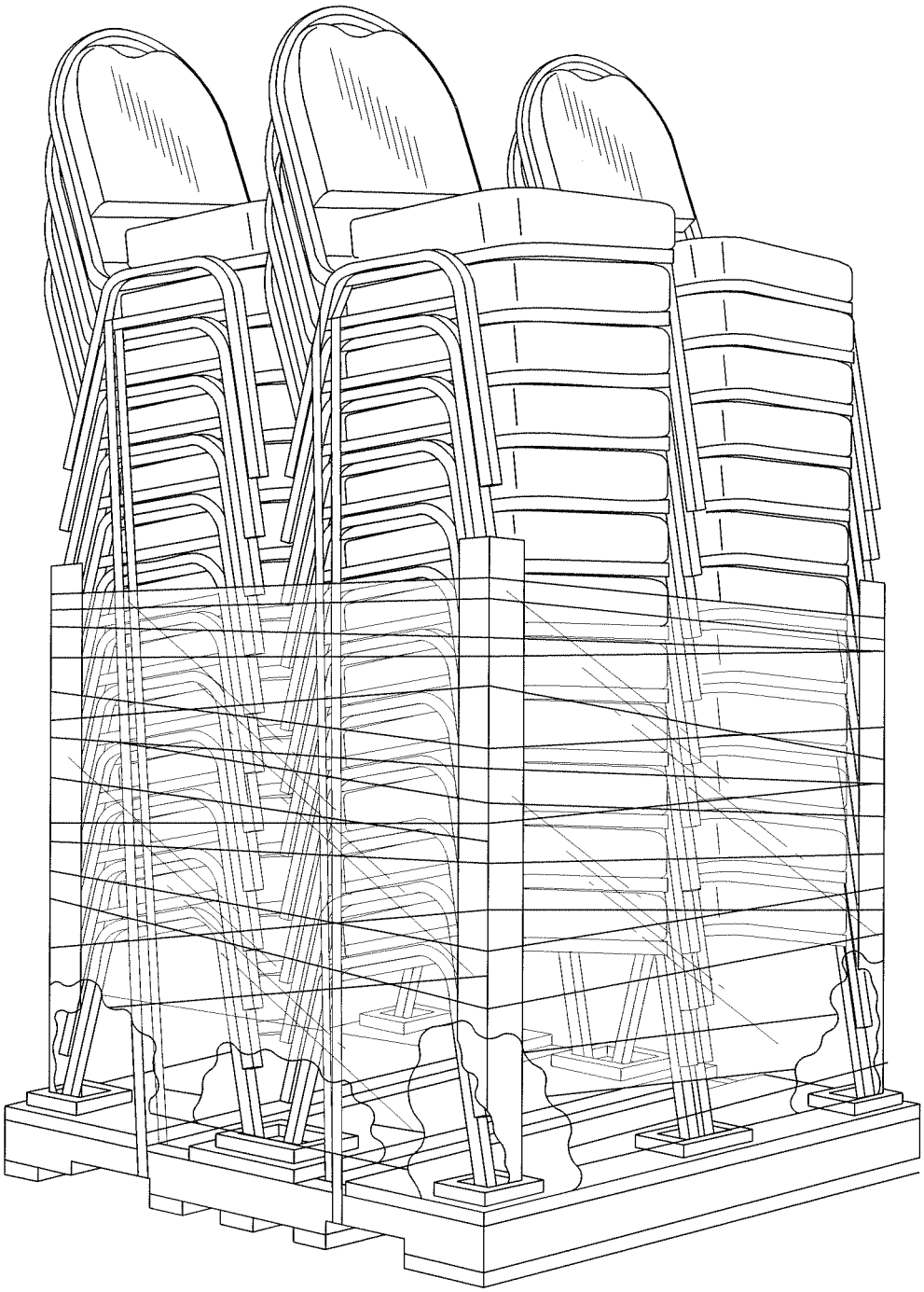
FIGS. 4 and 5, respectively, show an embodiment of a lower group and upper group of stacks according to the present invention.

The lower group, shown in FIG. 4, has four stacks of chairs on a pallet, with, in this case, eleven chairs in each stack. The height of each stack is preferably such that the chairs may be stacked and unstacked by hand without difficulty. The chairs in each stack are held together and to the pallet with, for example, banding straps extending from the underside of a pallet frame member, i.e., a stringer, vertically alongside the rear legs of a stack of chairs, to the top side of a horizontal side frame member of the top chair in the stack.

Figure 5:
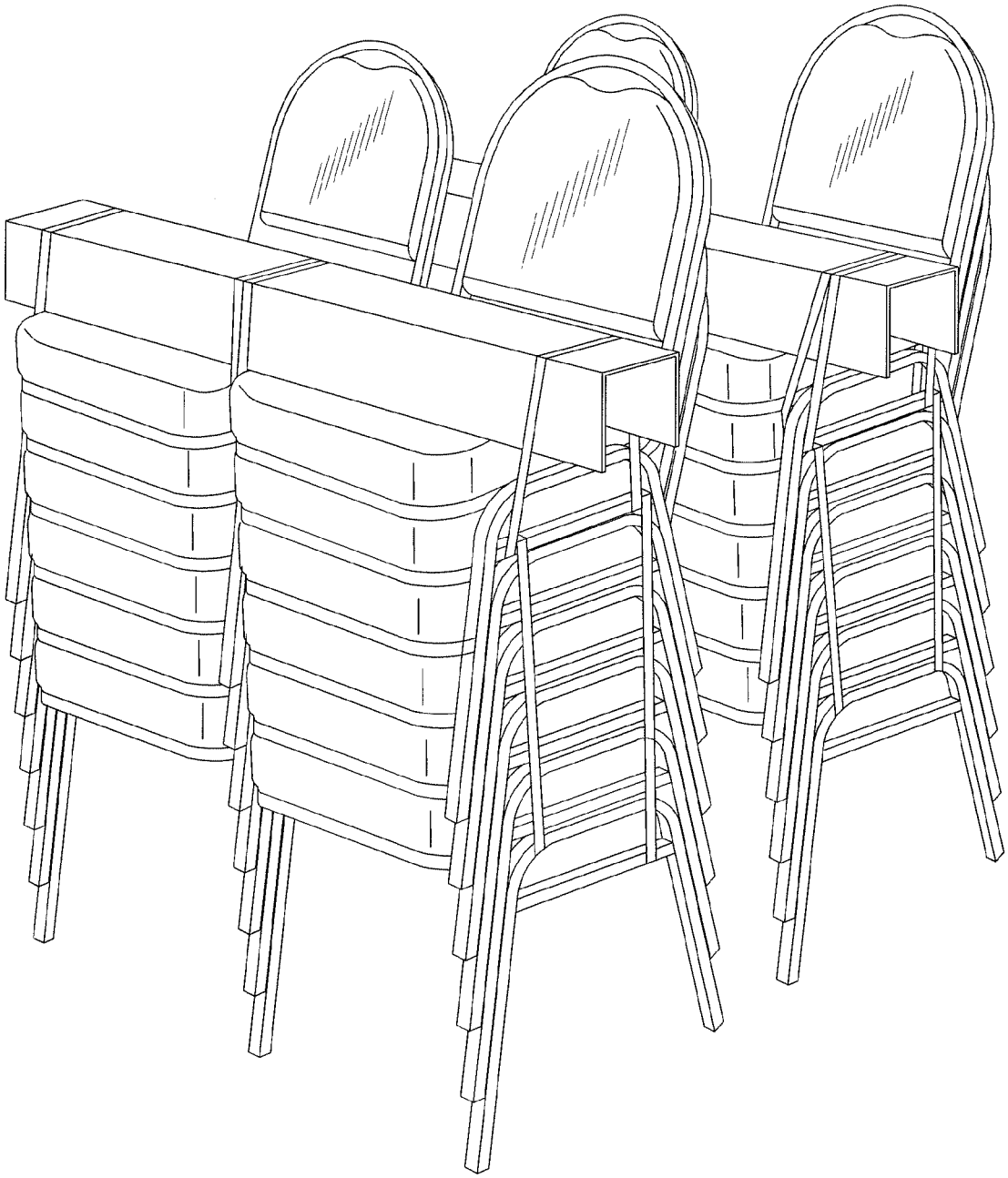

The upper group, shown in FIG. 5, has four stacks of chairs strapped together and provided with two lift tubes above the chair seats for receiving the forks of a forklift. The lift tubes are made of cardboard in one embodiment, although other materials and shapes are contemplated, and are preferably fastened to the chairs with strapping. The chairs are strapped together with banding straps which may extend vertically alongside the front and rear legs of the chairs in a given stack. One strap may extend, for example, in a loop from the underside of a horizontal side frame member of the bottom chair in the stack, vertically alongside the rear legs of the stack, to the top side of a horizontal side frame member of the top chair in the stack. Another strap may likewise run alongside the front legs of the stack. A separate banding strap may extend in a loop over each lift tube from one point to another on a horizontal side frame member of the top chair. Alternatively, the loop for the lift tube may be an extension of the strapping used to strap the chairs together.

In stacks of chairs with arms such as shown in FIG. 2, lift tubes may be placed below the arms of the top chairs in the stacks, or other protective material may be provided under the arms to facilitate lifting by the arms without damage.

Figure 6:
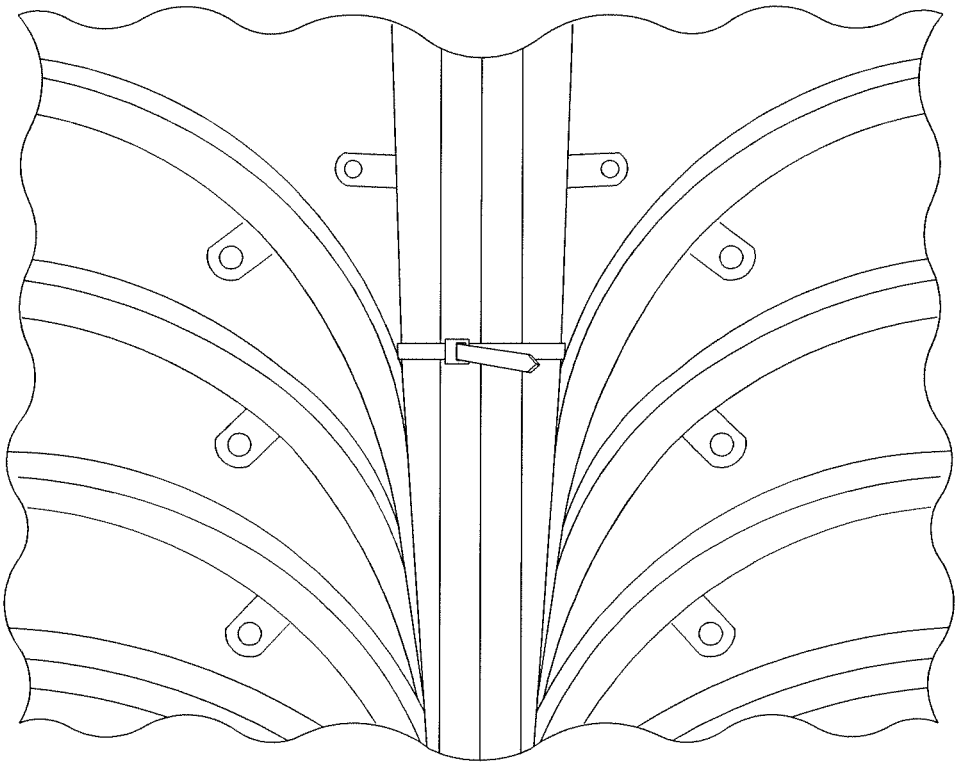
FIG. 6 illustrates one way in which laterally adjacent stacks of chairs may be held together, e.g., with zip ties around the legs of chairs.

The stacks in FIG. 5 are six chairs high, i.e., about half the height of the stacks in FIG. 4, and the chairs are readily stackable and unstackable by hand. The stacks may be held together side by side with, for example, one or more zip ties around the legs of chairs in laterally adjacent stacks as shown in FIG. 6.

Figure 7:
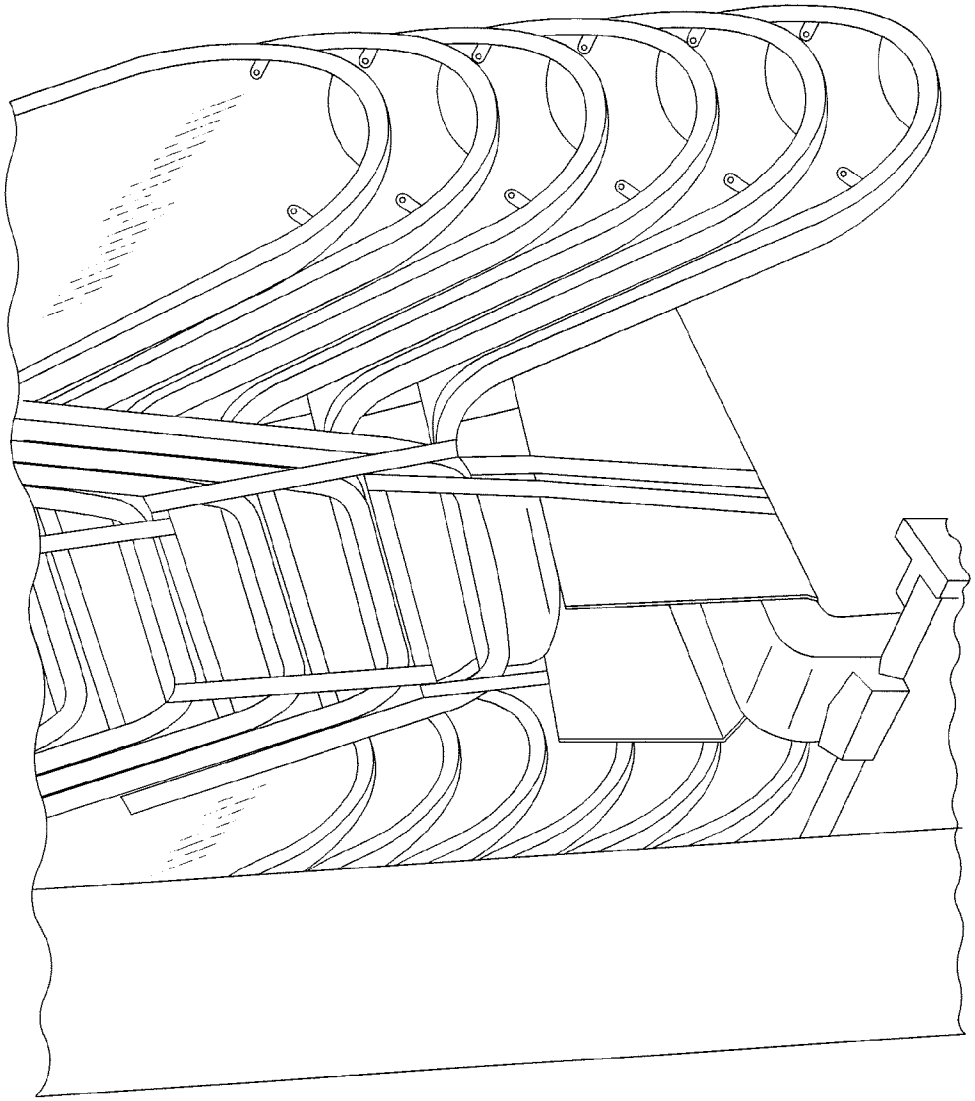
FIGS. 7-11 illustrate a process for mounting the upper group of chairs onto the lower group using a forklift.
Figure 8:
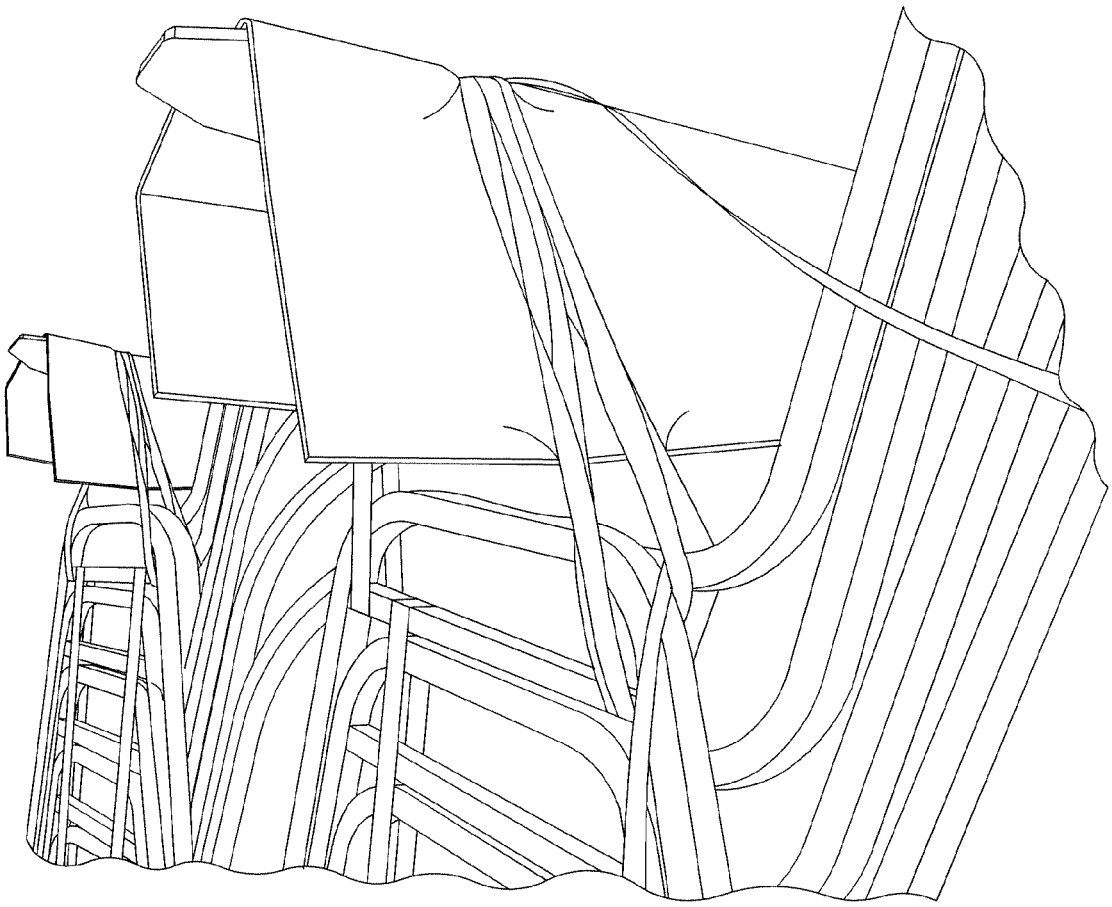
Figure 9:
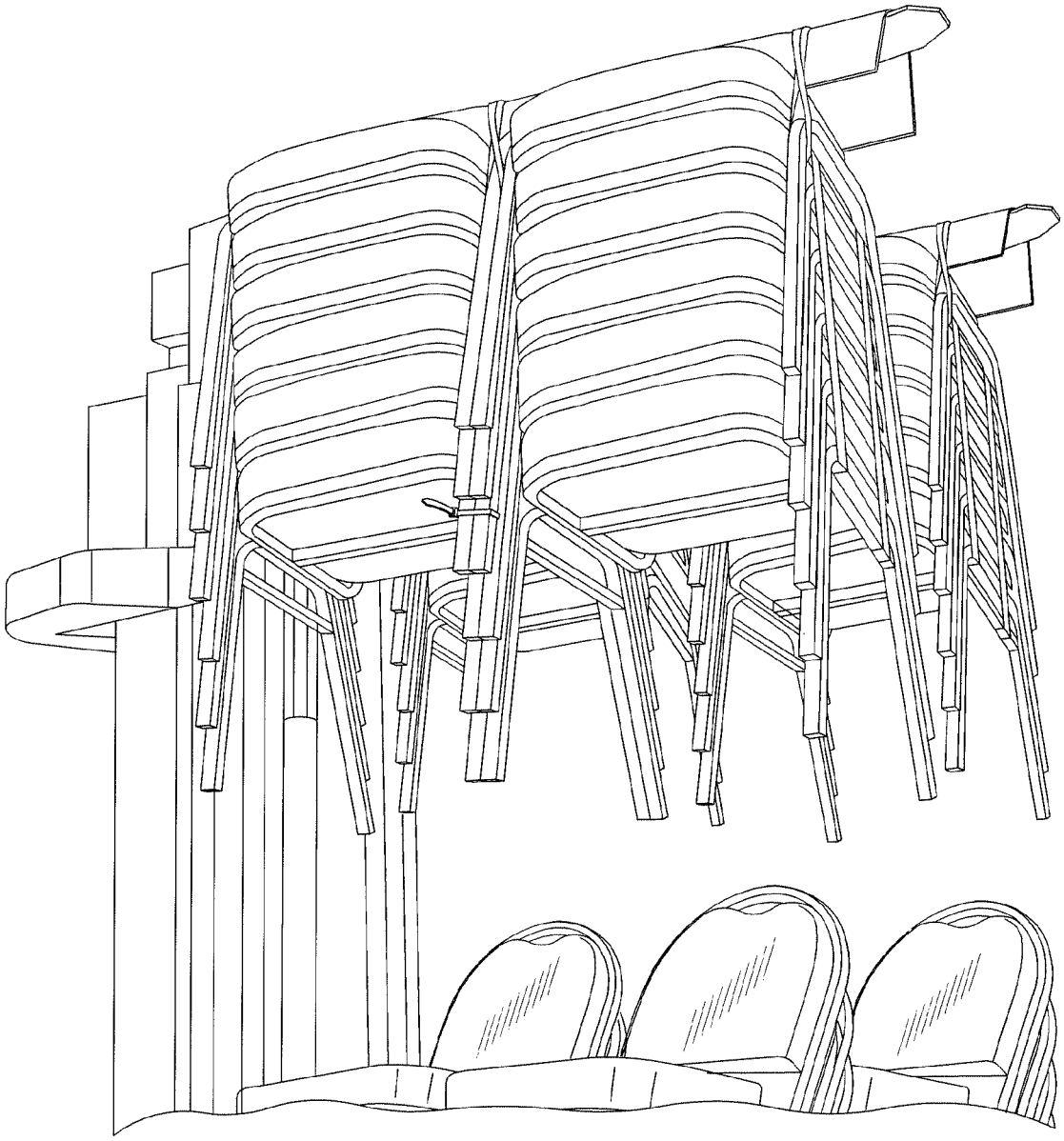
Figure 10:
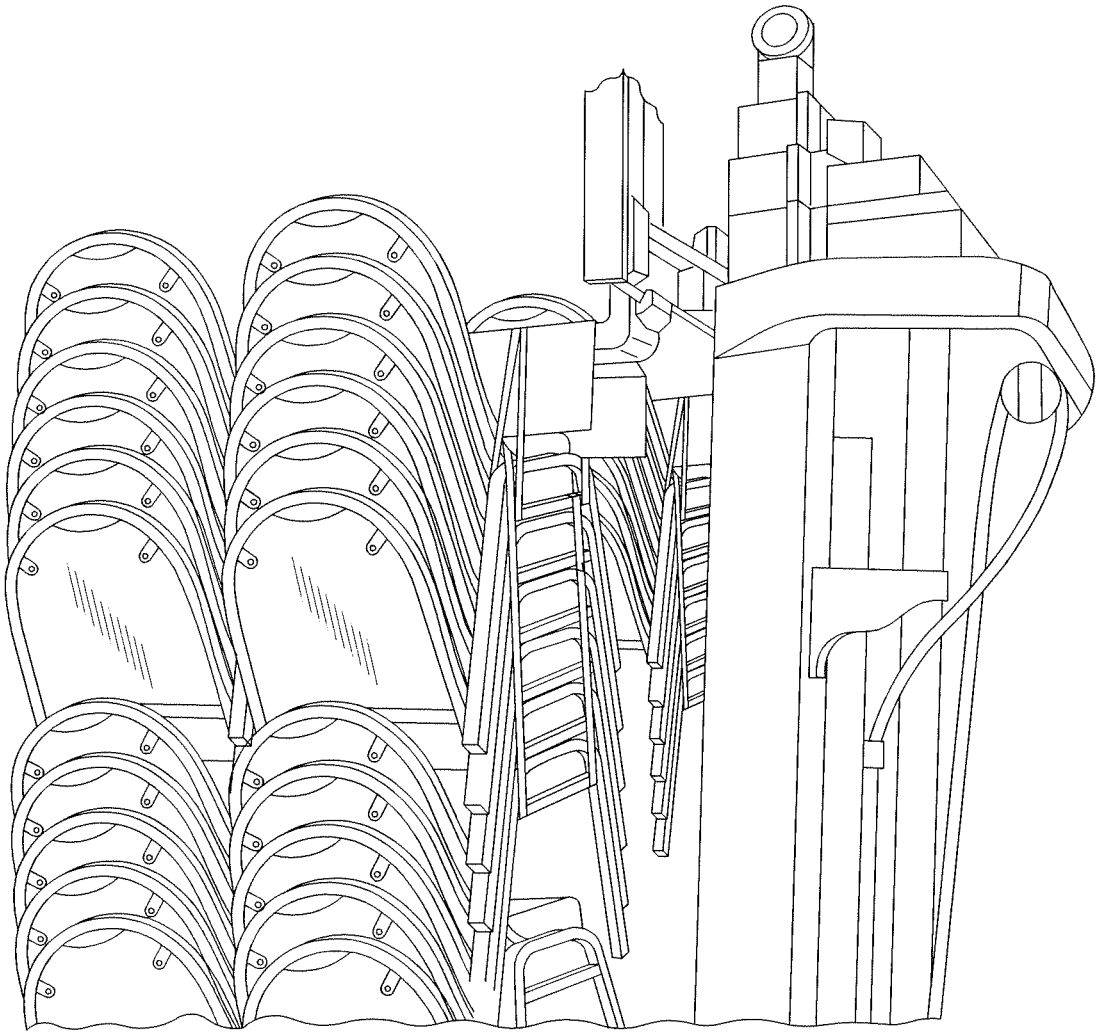

The upper stacks (FIG. 5) are designed to be mounted on the lower stacks (FIG. 4) with a forklift. The forks of a forklift are inserted into the lift tubes on the upper stacks as shown in FIGS. 7 and 8, the upper stacks are raised and moved into position over the lower stacks as shown in FIG. 9, and the upper stacks are then lowered onto the lower stacks as shown in FIG. 10. The combined stacks are taller and include more chairs than could readily be stacked safely on a pallet by hand. The upper group may be approximately the top ⅓ of the full stack.

Figure 11:
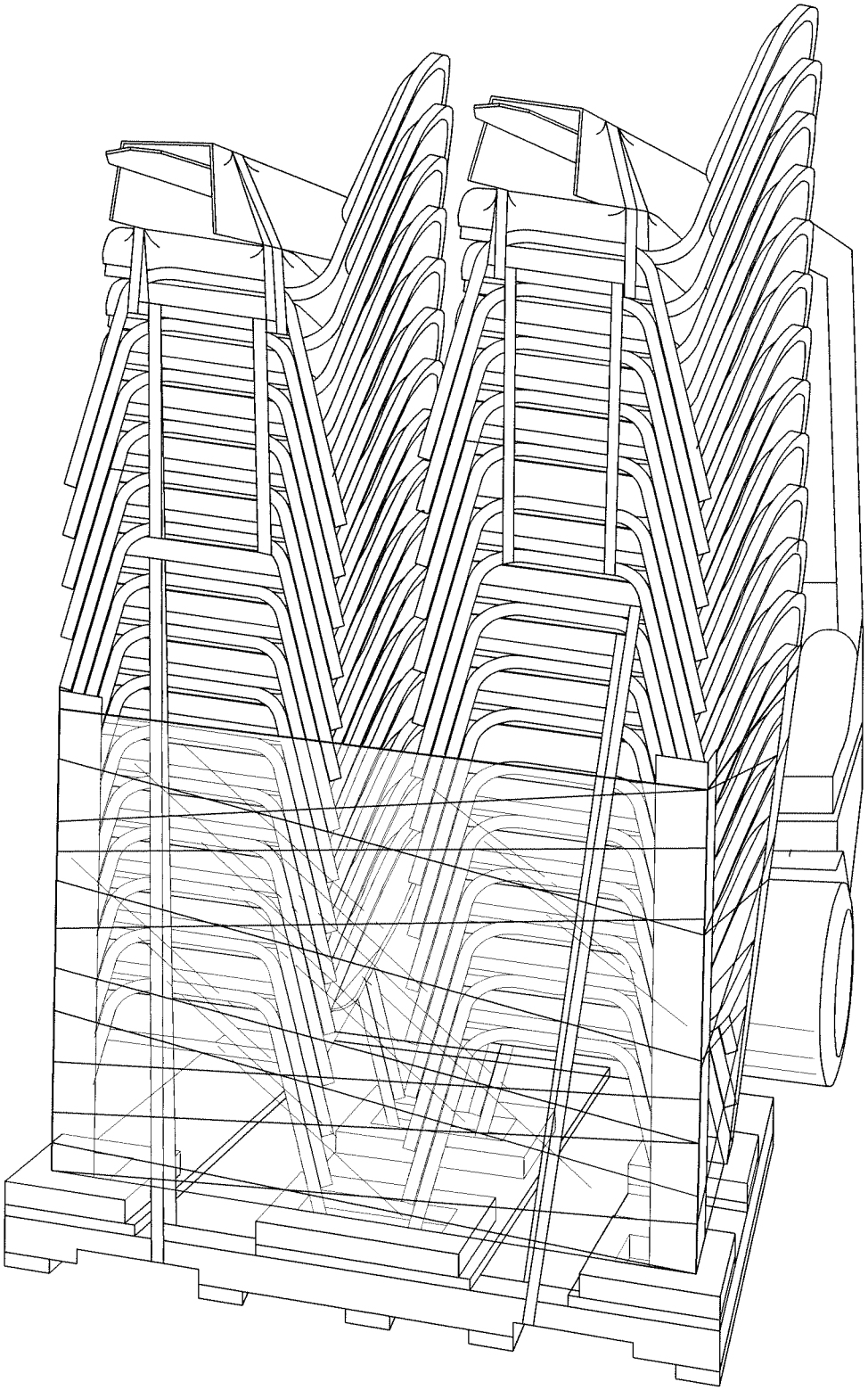

The full stack assembly comprising the stacks of FIG. 5 on top of the stacks of FIG. 4 may be wrapped with industrial wrapping material to add stability to the stack and to protect the chairs from damage and dirt. FIG. 11 shows the stacks partially wrapped. The wrap preferably has a pull tab, e.g., at the top, to facilitate removal of the wrapping. As the pull tab is pulled, the wrapping is split and can be pulled down partially as the chairs are unloaded.

The upper and lower stacks are separated during unloading with a forklift, which engages the lift tubes as shown in FIG. 11, lifts the upper stacks and lowers them to the ground. The strapping material is removed, and all the chairs can then be readily unstacked by hand.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

We claim:

1. A method of stacking chairs on a pallet so as to facilitate loading and unloading of the chairs on the pallet for transportation and/or storage, comprising:

providing a lower group of stackable chairs on said pallet, said lower group including first and second stacks of chairs facing toward or away from each other;

mounting an upper group of stackable chairs on said pallet, said upper group including third and fourth stacks of chairs separately coupled together such that each stack can be lifted as a unit, said third and fourth stacks being mounted on said pallet simultaneously;

wherein said upper group of chairs is lifted simultaneously onto said pallet using an auxiliary lift means removably provided above the seats of the top chairs in said third and fourth stacks, said lift means including a pair of lift members extending laterally across said top chairs.

2. The method of claim 1, wherein the chairs in each of said stacks in said upper group are strapped together.

3. The method of claim 1, further comprising the step of mounting said upper group of stackable chairs on said lower group of stackable chairs on said pallet.

4. A method of palletizing stackable chairs of the type having frames configured such that, when stacked, each stacked chair is offset toward the front of the chair on which it is stacked, the method comprising:

providing a pallet having an upper surface defining a generally horizontal plane and having a riser means on said upper surface proximate the perimeter thereof; and creating a stack of said chairs on said pallet with the front legs of the bottom chair on said riser means, wherein said stack comprises first and second substacks;

said method further comprising:

creating said first substack of chairs by stacking chairs on said pallet;

creating said second substack of chairs off said pallet; and mounting said second substack as a unit onto said first substack on said pallet.

5. The method of claim 4, wherein said riser means includes first and second riser blocks spaced apart a distance approximately equal to the spacing of the feet of the front chair legs.

6. The method of claim 5, wherein each riser block includes a recessed upper portion.

7. The method of claim 4, further comprising creating a plurality of horizontally adjacent stacks on said pallet, with one of said stacks facing another stack.

8. The method of claim 7, wherein said riser means includes a riser in the center of said pallet for one of the front legs of the bottom chair in the facing stack.

9. The method of claim 8, wherein said plurality of horizontally adjacent stacks on said pallet includes first and second stacks facing each other and sharing said riser in the center of said pallet.

10. The method of claim 4, wherein said stack comprises first and second vertically aligned substacks separately coupled together.

* * * * *